US007344482B2

(12) United States Patent
Checketts

(10) Patent No.: US 7,344,482 B2
(45) Date of Patent: Mar. 18, 2008

(54) ADJUSTABLE AQUATIC EXERCISE DEVICE

(76) Inventor: Stanley J. Checketts, P.O. Box 55, Providence, UT (US) 84332

( * ) Notice: Subject to any disclaimer, the term of this patent is extended or adjusted under 35 U.S.C. 154(b) by 703 days.

(21) Appl. No.: 10/898,838

(22) Filed: Jul. 26, 2004

(65) Prior Publication Data

US 2006/0019799 A1 Jan. 26, 2006

(51) Int. Cl.
*A63B 31/00* (2006.01)

(52) U.S. Cl. ..... 482/55; 482/38; 482/111

(58) Field of Classification Search ..... 482/23, 482/36, 37, 38, 39, 40, 41, 42, 55, 111, 143, 482/148, 908; D25/41; 182/82, 83, 85, 182/86, 90, 91, 92, 93, 95, 97, 120, 124; 4/496, 511

See application file for complete search history.

(56) References Cited

U.S. PATENT DOCUMENTS 3,973,646 A * 8/1976 Martinez ..... 182/97
4,552,245 A * 11/1985 Lindberg, Jr. ..... 182/97
4,875,673 A * 10/1989 Erickson ..... 482/55
4,941,659 A * 7/1990 Silvestri ..... 482/41
5,033,735 A * 7/1991 Erickson ..... 482/39
5,306,217 A * 4/1994 Bracone ..... 482/55
6,058,875 A * 5/2000 Krish, Jr. ..... 114/362

FOREIGN PATENT DOCUMENTS

GB 2201714 A * 9/1988

* cited by examiner

*Primary Examiner*—Jerome Donnelly
*Assistant Examiner*—Tam Nguyen
(74) *Attorney, Agent, or Firm*—Richard D. Clarke

(57) ABSTRACT

This new and unique adjustable cantilevered aquatic exercise device offers a clean modern appearing device for exercising on the side of a swimming pool or from the end of a diving board. By mounting two extension arms to two horizontal support arms connected and mounted to the pool deck surface by mounting plates, angle-mounting brackets or slid over the end of the diving board, a single exercise bar may be relocated between pluralities of orifices on the extension arms to achieve a wide variety of elevations to exercise at the side of a swimming pool. This device can be pivoted back from the edge of the pool and remains completely out of the water when in use, not requiring the need to be constructed from expensive materials, and may be finished with a wide variety of rust preventative and cushioned coatings.

6 Claims, 3 Drawing Sheets

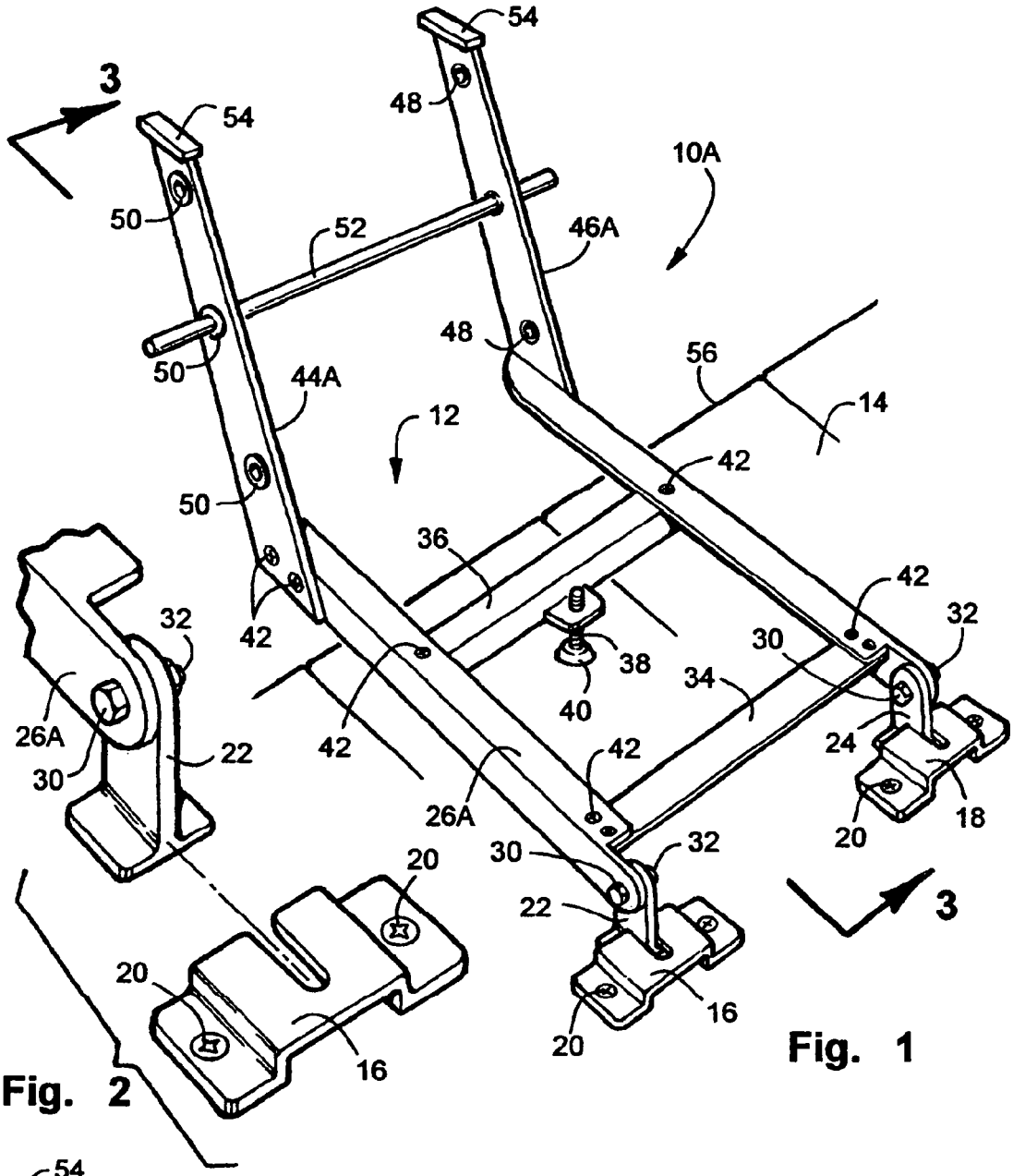
Fig. 1
Fig. 2
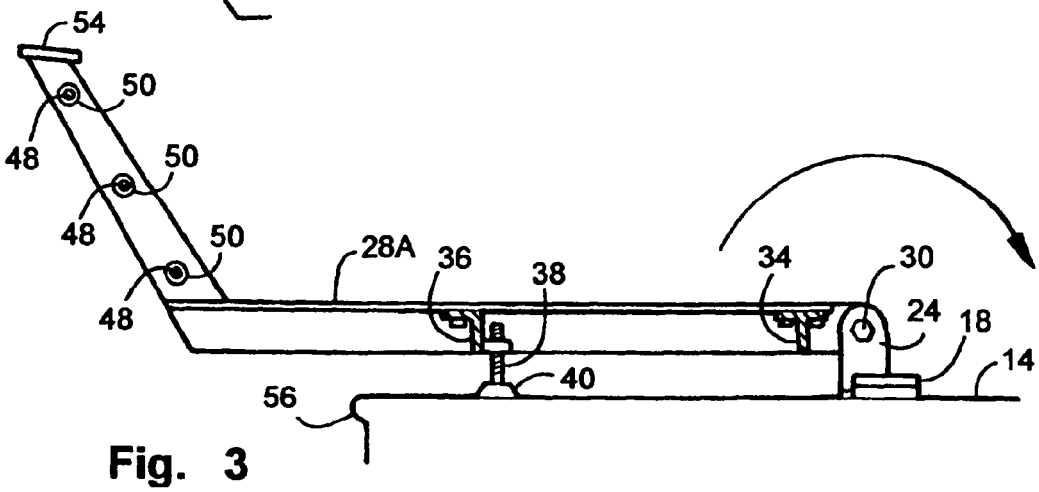
Fig. 3

ADJUSTABLE AQUATIC EXERCISE DEVICE

FIELD OF THE INVENTION

This invention relates to the field of physical fitness and exercise, in particular exercise in an aquatic environment. It provides a new and unique device that allows individuals to do a broad range of exercises in a cool, refreshing water environment. The desire of the inventor is to improve and simplify aquatic exercise equipment giving them a clean modern appearance in a swimming pool environment without having the equipment under the surface of the water.

BACKGROUND OF THE INVENTION

Due to the relatively recent awareness of advantages of physical fitness and the increasing number of obese people throughout the world, there has been an increased desire to exercise by individuals. Exercising can take any of many forms, for example: jogging, biking, tennis, etc. In addition to these forms of exercise there has been an upsurge of health clubs, fitness centers and the like which have come into being in recent years. Most of them are fitness centers that consist of a gym-like environment wherein members can come to workout on the various types of exercise machines and other exercise equipment. Most of these exercises are undertaken in a non-aquatic environment and tend to dehydrate the body, requiring the individuals to consume large quantities of water while exercising. It is well known that exercising in an aquatic environment is more beneficial to the person doing the exercise because of the resistive force of water being used to promote muscle tone, while the buoyancy of water reduces the likelihood of muscles stress. Exercising in the cool aquatic environment is invigorating and tends to reduce excessive sweating.

The convenience and economy of this adjustable cantilevered aquatic exercise device can be described by the clean modern design, the simplification of the mechanism and the poolside deck mountings or optional diving board attachment means.

U.S. Pat. No. 4,822,031 of Horst A. Olschewski describes a pool exercise device that includes a pair of supports having upright portions having a slot therein. End members having a regular angular geometric shape are removably positioned in the slots. Rods fixed to the end members project collinearly and are connected by a sleeve. The height of the rods is adjusted by removing the end members from the slots selectively rotating and returning the end members to the slots for securement therein, This invention offers a similar adjustable exercise bar that mounts on the horizontal poolside decking but does not offer the cantilevered structure that extends out over the pool and does not have the latitude of adjustments of the adjustable cantilevered aquatic exercise device. Also this invention does not offer the option of the adjustable cantilevered aquatic exercise device that removably attaches to the diving board.

U.S. Pat. No. 4,875,673 of Curtis Erickson discloses an aquatic exercise apparatus having a main frame with accurate upper supports, which are secured, to a pool decking and having lower supports connected thereto. The main frame is provided with a first upper pair and a second lower pair of outwardly projecting arms for user exercise purposes. An exercise platform is pivotally attached to the main frame and is adjustable in any position from vertical to ninety degrees relative to the main frame.

Although this invention has an upper structure that is secured to the pool-decking surface, a portion of the device extends below the surface of the water and rests or is attached to the vertical side of the pool below the surface of the water. Also, this invention does not offer the option of the adjustable cantilevered aquatic exercise device that removably attaches to the diving board of a swimming pool.

U.S. Pat. No. 4,941,659 of Claudio Silvestri teaches of an invention that relates to an aquatic exerciser or rehabilitation equipment and, particularly, to an exerciser mounted for positioning a user engaging component in a cantilevered configuration over the edge of a swimming pool or other water body. The exerciser suspends user-engaging members over the water and allows the user to carry out various exercises within the pool. Typically, the exercises include body-lifting exercises and in contrast to conventional body lifting exercises carried out outside the water, the force required by the user increases in proportion to the amount of his body that is above the water level. In other circumstances the difficulty may be increased by carrying out certain movements within the water at higher speeds with the water providing a drag force as an increasing function of the speed. Thus, the user can either increase or decrease the difficulty of the exercise easily.

This is another patent that is similar in that it attaches to the pool-decking surface and extends outwardly over the pool surface, but this invention offers no adjustability in the location of the user-engaging members and does not offer the option of the adjustable cantilevered aquatic exercise device that removably attaches to the diving board of a swimming pool.

U.S. Pat. No. 5,586,961 of Jeffery T. Quint tells of a universal aquatic exercise machine that includes a plurality of exercise devices, for example: a first exercise device rotatably mounted on a base that moves through a rotary path of motion; a second exercise device rotatably connected to the base that moves back and forth in a reciprocating motion; and a third exercise device mounted on the base for reciprocating back and forth motion. The aquatic exercise machine includes a pivoting seat that permits the exercise devices to be performed in either a seated or an erect posture. The exercise devices may have fixed area resistance elements, or variable area resistance elements. In addition, underwater footwear facilitates submerged leg exercises and activities such as sliding, skating and other activities.

This patent describes a device that rests on the bottom of a pool beneath the surface of the water and has a variety of exercise mechanisms, but has no similarities to the adjustable cantilevered aquatic exercise device.

U.S. Pat. No. 5,033,735 of Curtis Erickson describes an aquatic exercise device wherein several embodiments are disclosed. The first embodiment utilizes a unitary aquatic exercise device which is adaptable for use with a conventional pool ladder. The second embodiment is directed to a unitary aquatic exercise device, which is adaptable for use with an inverted pool ladder. Both of these embodiments are readily placed in the vertical position when not in use and are also readily removable from the pool when so desired. A third embodiment utilizes a unitary aquatic device which includes mounting legs that are permanently mounted in recesses of the pool decking. All of these embodiments are made of lightweight PVC components eliminating any corrosion problems and also rendering the device readily cleanable.

This patent describes an invention that attaches to a conventional pool ladder of other existing poolside hand bars. Pool ladders and other hand bars are not designed for the loads put on them by additional apparatus and the leverage incurred by the individuals using these apparatus. Significant damage may be done to the pool by the devices of this kind. This invention is partially submerged below the water level and has no similarities to the adjustable cantilevered aquatic exercise device U.S. Pat. No. 5,860,171 of Billy Gene Hicks describes an apparatus suspending a detachable accessory adjacent to a vertical wall defining a swimming pool. The apparatus includes a pair of U-shaped arms having base ends fixed outside the swimming pool and cantilever ends supported inside the swimming pool below the base ends. A support bar is rotatably mounted between the arms and includes a plurality of mounting tubes within which a plurality of accessories are detachably mounted.

This patent consists of a mounting system for detachable swimming pool accessories that attaches to the pool-decking surface but also has attachments below the surface of the water on the vertical side of the pool and has no similarities to the adjustable cantilevered aquatic exercise device.

U.S. Pat. No. 5,868,649 of Curtis Erickson et al. tells of an aquatic exercise device which is to be used within a body of water such as a pool and has an element which can be engaged by the foot or hand of an individual linked to a piston-cylinder combination so that as the user engagement element is moved by the user, the piston rides in the cylinder. At the head end of the cylinder there is an opening, which provides communication between the cylinder chamber and the water environment. As the piston moves back and forth water is either pushed out of the chamber through that opening or drawn into the chamber through that opening. The size of the opening, which may be selected by the user, determines the degree of resistance to the user's movement against the user engagement element.

This patent describes an apparatus that mounts to the pool-decking surface, but rests on or attaches to the pool vertical side surface with the majority of the device below the surface of the water. It does not indicate any of the unique capabilities of the adjustable cantilevered aquatic exercise device.

U.S. Pat. No. 6,033,351 of James A. Sizemore III et al. teaches of an aquatic abdominal exercise apparatus having a pair of parallel tubular arms connected together by a first connecting member mounted over a pool deck surface juxtaposed to an edge of a pool. The arms extend downwardly along a side edge of the pool and then turn inwardly to space the apparatus from the pool wall. A second connecting member connects the portion of the arms extending downwardly and a back support is mounted on the second connecting member. A pair of arm supports project outwardly from the portion of the arms extending downwardly to provide hand supports for the exerciser.

This invention mounts to the pool deck surface with arms extending downwardly into the pool to rest against the vertical side with the structure of the device below the surface of the pool and has no similarities to the adjustable cantilevered aquatic exercise device.

Thus there is a continuing need for improving and simplifying the many aquatic exercise devices used by individuals in pools while increasing their capabilities.

SUMMARY OF THE INVENTION

The object of this invention is to create an adjustable cantilevered aquatic exercise device that has a clean modern design for the swimming pool environment.

Another object of this invention is to create an adjustable cantilevered aquatic exercise device that can pivot away from the pool edge or be easily removed from the mounting plates on the pool deck surface.

Another object of this invention is to create an adjustable cantilevered aquatic exercise device that can be mounted on the pool deck surface, not requiring any mountings below the surface of the water.

Another object of this invention is to create an adjustable cantilevered aquatic exercise device that in an alternate embodiment can be slid over the end of the diving board, not requiring any permanent attachments.

Another object of this invention is to create an adjustable cantilevered aquatic exercise device that can be adjusted and have one or more levels of application.

Still another object of the invention is to create an adjustable cantilevered aquatic exercise device that is not under the surface of the water.

Yet another object of this invention is to create an adjustable cantilevered aquatic exercise device that will allow a variety of exercise movements for individuals of varying capabilities.

A further object of this invention is to create an adjustable cantilevered aquatic exercise device that is portable and can be taken to other locations.

A final object of this invention is to advance and simplify aquatic exercise devices while increasing their capabilities.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred and alternate embodiments of the invention.

The preferred embodiment of this device consists of an adjustable cantilevered aquatic exercise device that will be attached to the horizontal pool deck surface by the means of two mounting plates. The mounting plates will be anchored to the horizontal pool deck surface by the means of inserting anchors in the concrete surface of the pool deck surface and permanently attaching the mounting plates. Two inverted "T" pivot arms that will slide into the mounting plates are attached to two horizontal support arms spaced apart by a "T" brace adjacent to the inverted "T" pivot arms and an angle brace incorporating an adjustable support leg with a rubber non-slip end. Minor adjustments of the height and level of the device may be made by screwing in or out the adjustable support leg. The "T" brace and the angle brace will be attached to the horizontal support arms by the means of conventional threaded fasteners for easy shipping and assembly, but in some cases the "T" brace and the angle brace will be welded into position and still remain within the scope of this patent. Two extension arms are fixably attached to the distal ends of the two horizontal support arms by the means of conventional fasteners. Each of the extension arms has a plurality of orifices aligning on one or more axes when mounted to the distal ends of the horizontal support arms. Each orifice in the two extension arms is equipped with a nylon bushing to allow for a smooth sliding support of the adjustable exercise bar. Rubber boots at the distal ends of the extension arms allow that when the device is pivoted 108 degrees, it will rest on the rubber boots on the pool deck surface. By positioning the adjustable exercise bar within the bushings in the matching orifices of the two extension arms at different elevations, the person using the device can vary the buoyancy level of their body and thus adjust the degree of effort in their exercise program. In this preferred embodiment the adjustable cantilevered aquatic exercise device may be rotated 180 degrees to be out of the way of the pool edge or may be easily removed by lifting the device slightly and sliding the inverted "T" arms out of the mounting plates. When the adjustable cantilevered aquatic exercise device is in position over the pool edge the rubber non-slip end of the adjustable support leg holds the inverted "T" arms in position within the mounting plates.

The first alternate embodiment of this device consists of the adjustable cantilevered aquatic exercise device permanently anchored to the horizontal deck surface of a swimming pool by the means of a forward angle bracket and a rear angle bracket. Conventional concrete anchors with mounting nuts are used for the means of attachment to the horizontal pool deck surface. Two horizontal support arms are attached to the forward angle-mounting bracket and the rear angle-mounting bracket and extend outwardly over the pool edge. Two extension arms are fixably attached to the distal ends of the two horizontal support arms by the means of conventional fasteners. Each of the extension arms has a plurality of orifices aligning on one or more axes when mounted to the distal ends of the horizontal support arms. Each orifice in the two extension arms is equipped with a nylon bushing to allow for a smooth sliding support of the adjustable exercise bar.

The second alternate embodiment of the adjustable cantilevered aquatic exercise device consists of the device being easily slid over the end of the swimming pool diving board. This device is similar in construction to the preferred embodiment of the device in that it has two horizontal support arms that in this case grip the sides of the diving board. A top strap and a bottom strap are attached to the horizontal support arms providing the leverage points for restraining the device on the end of the swimming pool diving board. The extension arms with the orifices and bushings are attached to the horizontal support arms by common fasteners. It must be understood that the top strap and the bottom strap could be reversed in their mounting position or be on both top and bottom of the device so that the device can be used with the extension arms directed downwardly instead of in an upward direction, giving a wider range of adjustability or lowering the adjustable exercise bar if the diving board is too far off the surface of the water.

A third alternate embodiment of the adjustable cantilevered aquatic exercise device can have orifices and bushings for a single workout bar with the extension arms in a horizontal position and will also be covered within the scope of this patent.

The extension arms of the device have been depicted in the up position, but it must be understood that by reversing the extension arms that they will extend in a downward direction with the same intended purpose and this will still remain within the scope of the patent.

All of the embodiments of this invention either mount to the pool deck surface or to the end of the diving board and they are not intended to extend to or penetrate the surface of the swimming pool water.

With respect to the above description it is to be realized that the optimum dimensional relationships for the parts of the invention, including variations in size, materials, shape, coatings, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

FIG. 1 depicts a perspective view of the preferred embodiment of the adjustable cantilevered aquatic exercise device attached to the pool deck surface by the means of two mounting plates.

FIG. 2 depicts a perspective view of the a single mounting plate and a single inverted "T" arm connected to the horizontal support arm by the means of a conventional bolt and locking nut.

FIG. 3 depicts a side section view of the preferred embodiment of the adjustable cantilevered aquatic exercise device attached to the pool deck surface by the means of two mounting plates.

DETAILED DESCRIPTION OF THE PREFERRED EMBODIMENTS

Figure 4:
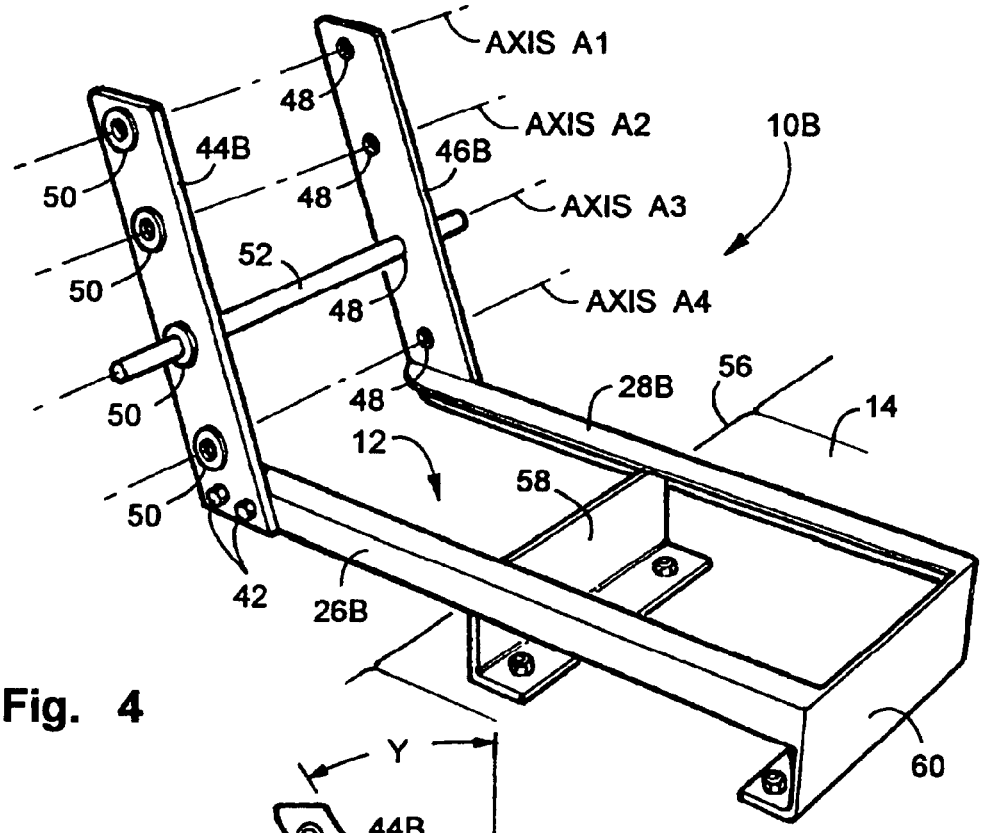
FIG. 4 depicts a perspective view of the first alternate embodiment of the adjustable cantilevered aquatic exercise device permanently anchored to the pool deck surface.

Referring now to the drawings, wherein similar parts of the invention are identified by like reference numerals, there is seen in FIG. 1 a perspective view of the preferred embodiment of the adjustable cantilevered aquatic exercise device 10A extending over a swimming pool 12 attached to the pool deck surface 14 by the means of two mounting plates 16 and 18 held in place by screws 20 attached to conventional concrete anchors in the pool deck surface 14. FIG. 2 illustrates how the two inverted "T" pivot arms 22 and 24 slide into the mounting plates 16 on the pool deck surface 14 when installing the device. FIG. 3 clarifies how the two inverted "T" arms 22 and 24 are attached to two horizontal support arms 26A and 28A by the means of a bolt 30 and lock nut 32 and are spaced apart by a "T" brace 34 adjacent to the two inverted "T" pivot arms 22 and 24 and an angle or "L"-shaped brace 36 incorporating an adjustable support leg 38 with a rubber non-slip end 40. Minor adjustments of the height and level of the device may be made by screwing in or out the adjustable support leg 38. The "T" brace 34 and the angle brace 36 will be attached to the horizontal support arms 26A and 28A by the means of conventional threaded fasteners 42 for easy shipping and assembly, but in some cases the "T" brace 34 and the angle brace 36 will be welded into position and still remain within the scope of this patent. Two extension arms 44A and 46A are fixably attached to the distal ends of the two horizontal support arms 26A and 28A by the means of conventional fasteners 42. Each of the extension arms 44A and 46A has a plurality of orifices 48 aligning on one or more axes A1, A2, A3 or A4 illustrated in FIG. 4. Each orifice 48 in the two extension arms 44A and 46A is equipped with a nylon bushing 50 to allow for a smooth sliding support of the adjustable exercise bar 52. Rubber boots 54 at the distal ends of the extension arms 44A and 46A allow that when the device is pivoted 108 degrees, it will rest on the rubber boots 54 on the pool deck surface 14. By positioning the adjustable exercise bar 52 within the nylon bushings 50 in the matching orifices 48 of the two extension arms 44A and 46A at different elevations, the person using the device can vary the buoyancy level of their body and thus adjust the degree of effort in their exercise program. This preferred embodiment of the adjustable cantilevered aquatic exercise device 10A may be rotated 180 degrees to be out of the way of the pool edge 56 or may be easily removed by lifting the device slightly and sliding the inverted "T" arms 22 and 24 out of the mounting plates 16 and 18. When the adjustable cantilevered aquatic exercise device 10A is in position over the pool edge 56 the non-slip rubber end 40 of the adjustable support leg 38 holds the inverted "T" arms 22 and 24 in position within the mounting plates 16 and 18.

The first alternate embodiment of this device shown in FIG. 4, consists of the adjustable cantilevered aquatic exercise device 10B permanently anchored to the pool deck surface 14 of a swimming pool 12 by the means of a forward angle mounting bracket 60 and a rear angle mounting bracket 62. Conventional concrete anchors with mounting screws 20 are used for the means of attachment to the pool deck surface 14. Two horizontal support arms 26B and 28B are attached to the forward angle-mounting bracket 58 and the rear angle-mounting bracket 60 and extend outwardly over the pool edge 56 of the pool deck surface 14. Two extension arms 44B and 46B are fixably attached to the distal ends of the two horizontal support arms 26B and 28B by the means of threaded fasteners 42. Each of the extension arms 44B and 46B has a plurality of orifices 48 aligning on axes A1, A2, A3 and A4 when mounted to the distal ends of the horizontal support arms 26B and 28B. Each orifice 48 in the two extension arms 44B and 46B is equipped with a nylon bushing 50 to allow for a smooth sliding support of the adjustable exercise bar 52. The position of the extension arms 44B and 46B could be reversed to allow the extension arms 44B and 46B to project downwardly instead of upwardly as shown in FIGS. 1, 3, 4, 5 and 6 to get them closer to the surface of the water, and still remain within the scope of this patent.

Figure 5:
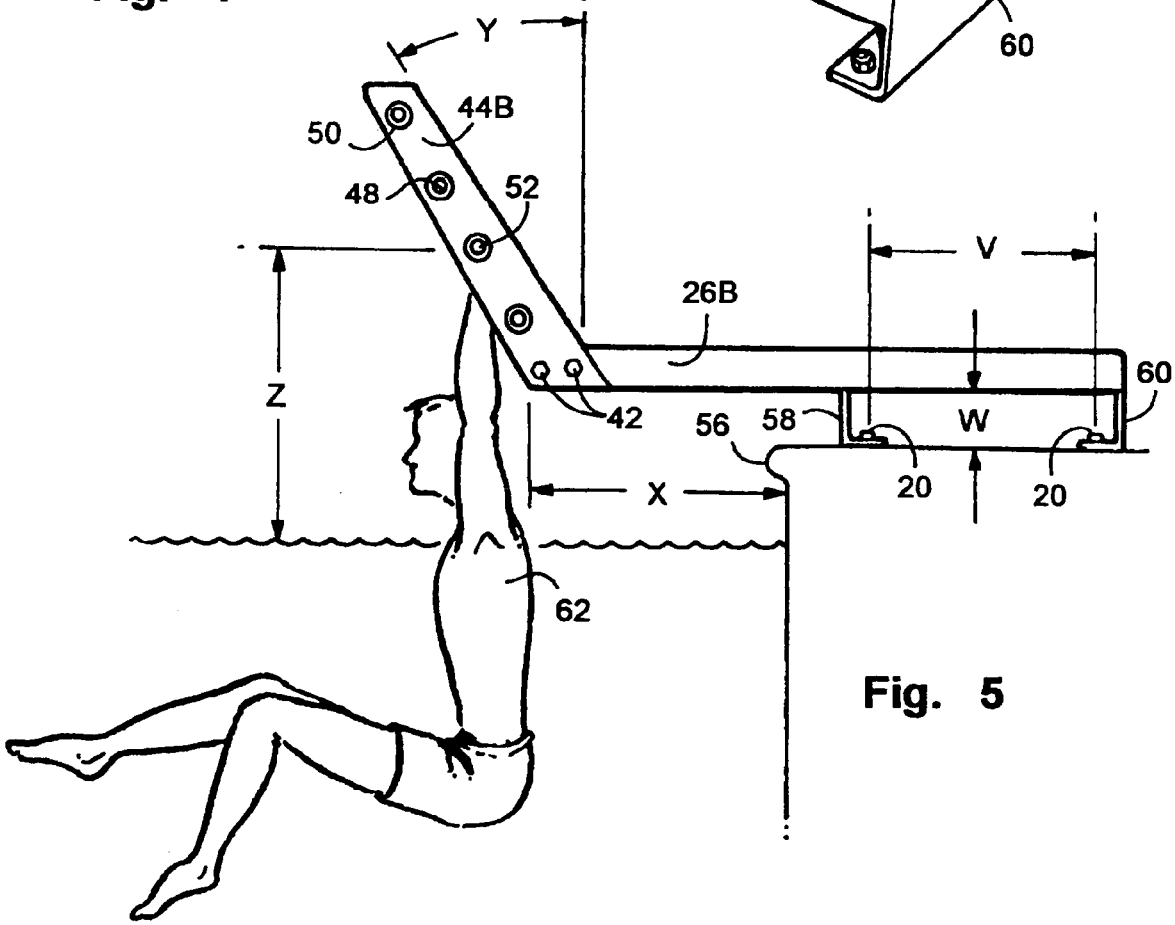
FIG. 5 depicts a side view of the first alternate embodiment of the adjustable cantilevered aquatic exercise device permanently mounted on the pool deck surface

FIG. 5 depicts a side view further illustrating the adjustable cantilevered aquatic exercise device 10B mounted in the pool deck surface 14 to illustrate the positioning of the device with relation to the pool edge 56 and the other pertinent design features. The spacing V of the concrete anchors and mounting screws 20 will vary with the desired size of the adjustable cantilevered aquatic exercise device 10B and the weight of the individuals using the device. The height W of the forward angle mounting bracket 58 and the rear angle-mounting bracket 60 will be 3 inches in the described embodiment but also may vary with the size and requirements of the individuals using the device. The horizontal support arms 26B and 28B will extend a distance X, 18 inches past the pool edge 56 in the first alternate embodiment of the adjustable cantilevered aquatic exercise device 10B with the understanding that this also may vary with the size and weight of the person 62 using the device. The extension arms 44B and 46B are shown at a 60-degree angle Y off the horizontal support arms 26B and 28B.

It must be fully understood that on all of the embodiments of the adjustable cantilevered aquatic exercise device 10A, 10B, 10C and 10D the angle Y may vary from being horizontal to being 90 degrees from horizontal, the number of orifices 48 and nylon bushings 50 in the extension arms 44B and 46B may be one or more on each side and the distance X between the distal end of the horizontal support arms 26B and 28B and the pool edge 56 also may vary and still be within the scope of this patent.

Figure 6:
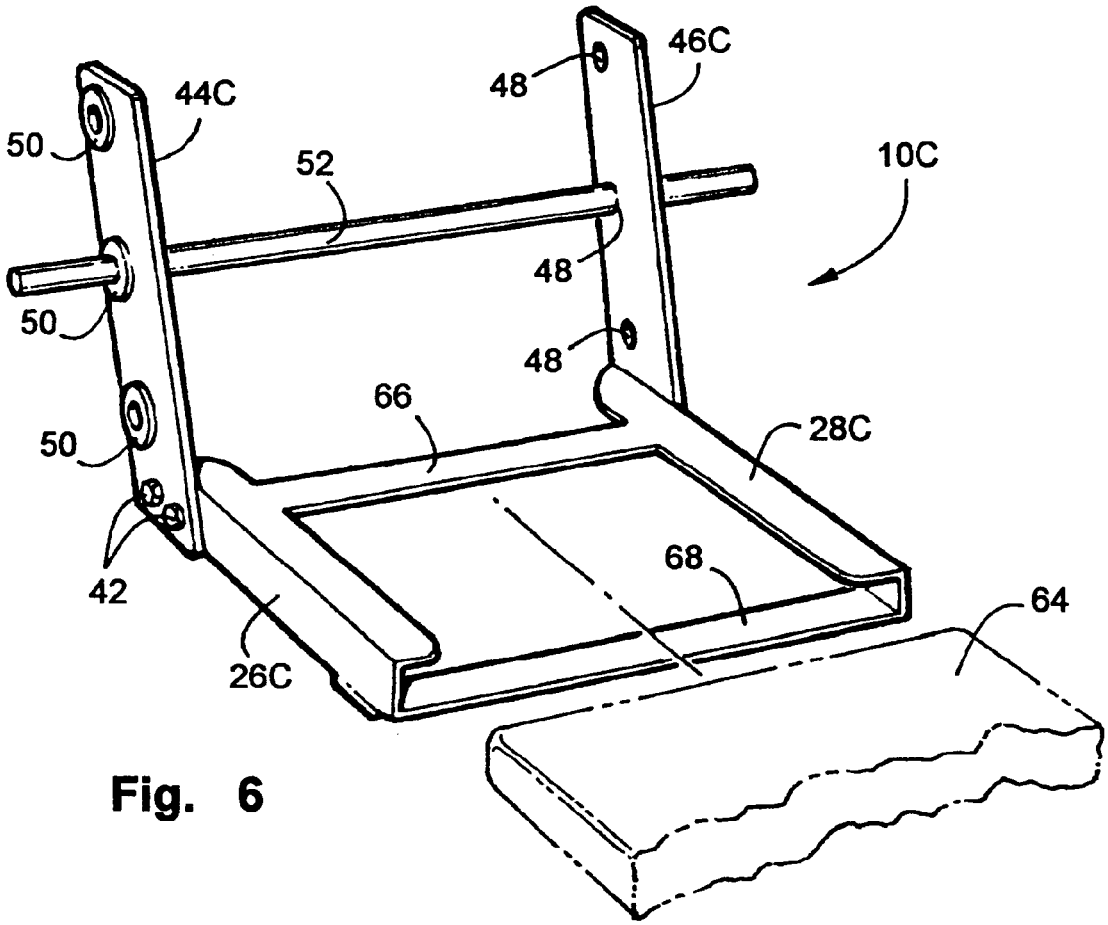
FIG. 6 depicts a perspective view the second alternate embodiment of the adjustable cantilevered aquatic exercise device removed from the swimming pool diving board.

FIG. 6 depicts a perspective view the second alternate embodiment of the adjustable cantilevered aquatic exercise device 10C illustrating the convenience of being easily placed over and removed from a swimming pool diving board 64. The second alternate embodiment of the adjustable cantilevered aquatic exercise device 10C is similar in construction to the preferred embodiment of the adjustable cantilevered aquatic exercise device 10A and 10B in that it has two horizontal support arms 26C and 28C that in this case grip the sides of the diving board 64. A top strap 66 and a bottom strap 68 are attached to the horizontal support arms 26C and 28C providing the leverage points for restraining the device on the end of the swimming pool diving board 64. The extension arms 44C and 46C with the orifices 48 and nylon bushings 50 are attached to the horizontal support arms 26C and 28C by threaded fasteners 42. It must be understood that the top strap 66 and the bottom strap 68 could be reversed in their mounting position or be on both top and bottom of the device so that the second alternate embodiment of the adjustable cantilevered aquatic exercise device 10C can be used with the extension arms 44C and 46C directed downwardly instead of in an upward direction if the diving board 64 is too far off the surface of the water.

Figure 7:
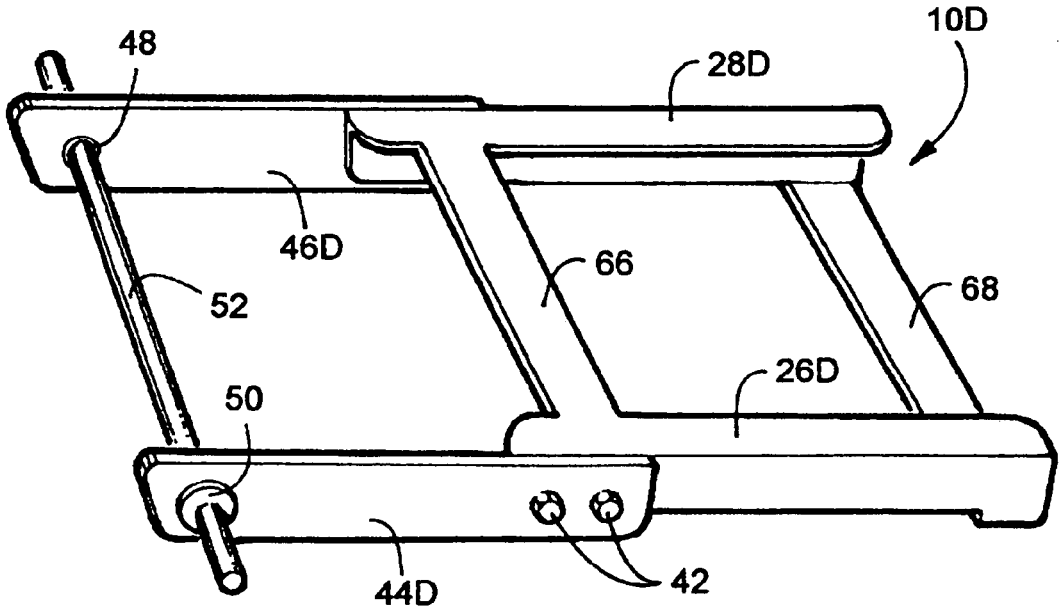
FIG. 7 depicts a perspective view of second alternate embodiment of the adjustable cantilevered aquatic exercise device with mountings for a single workout bar.

FIG. 7 depicts a perspective view of a third alternate embodiment of the adjustable cantilevered aquatic exercise device 10D with orifices 48 and nylon bushings 50 for an adjustable exercise bar 52 with the extension arms 44D and 46D in a horizontal position extending from horizontal support arms 26D and 28D.

The adjustable cantilevered aquatic exercise device 10A, 10B, 10C and 10D shown in the drawings and described in detail herein disclose arrangements of elements of particular construction and configuration for illustrating preferred and alternate embodiments of structure and method of operation of the present invention. It is to be understood, however, that elements of different construction and configuration and other arrangements thereof, other than those illustrated and described, may be employed for providing an adjustable cantilevered aquatic exercise device 10A, 10B, 10C and 10D in accordance with the spirit of this invention, and such changes, alternations and modifications as would occur to those skilled in the art are considered to be within the scope of this invention as broadly defined in the appended claims.

I claim:

1. An adjustable cantilevered aquatic exercise device comprising:

a) a pair of removable mounting plates disposed at a given distance from each other, each plate having a raised middle portion that includes a slot and two flat end portions that are adapted to be secured flush against a horizontal support surface with both slots facing the same direction;

b) a pair of inverted "T"-shaped pivot arms, each having a horizontal leg and a vertical leg wherein one of said pivot arms is slidably connected to each mounting plate such that the horizontal leg slides almost completely underneath the raised middle portion and the vertical leg slidably locks within the slot thereby removably coupling the pivot arms to the support surface;

c) a pair of horizontal support arms configured parallel to each other, each having a first end and a second end wherein the first end of each support arm is pivotally coupled to one of said "T"-shaped pivot arms in order for the support arms to pivot in unison, and the support arms are interconnected by a pair of elongated braces each extending perpendicularly to and between the support arms, the first of said braces having a "T"-shaped cross section is disposed near the first end of the support arms while the second of said braces having an "L"-shaped cross section and a height adjustment means is disposed near a midpoint of the length of the support arms, d) a pair of extension arms, each having a plurality of orifices disposed along its length and each fixedly coupled to the second end of one of said horizontal support arms such that the extension arms extend in parallel substantially diagonally relative to the horizontal support arms with the orifices of one extension arm lining up with the orifices of the other extension arm; and e) an adjustable exercise bar, slidably disposed in an orifice of both the first and second extension arms, is secured substantially horizontally and parallel to the support surface within the extension arms so as to provide support to a user wherein the height adjustment means includes a threaded adjustable support leg that is rotatable within a flange extending from a medial portion of the second brace and the threaded adjustable support leg is adapted to rest on the support surface when the support arms are positioned substantially parallel to the support surface such that the height of the support arms and thus the exercise bar is adjustable by rotating the adjustable support leg relative to the flange, the mounting plates are adapted to be secured to a deck surface of a pool so that the pivot arms can be secured thereto, the horizontal supports may be pivoted to a position to be substantially parallel to the support surface and the extension arms are extended over the pool edge to allow the user, while in the pool, to exercise while grasping the exercise bar that is slidably connected to the extension arms.

2. The adjustable cantilevered aquatic exercise device according to claim 1, wherein said L-shaped brace is attached to the horizontal support arms by means of conventional threaded fasteners.

3. The adjustable cantilevered aquatic exercise device according to claim 1, wherein said L-shaped brace is welded to said horizontal support arms.

4. The adjustable cantilevered aquatic exercise device according to claim 1, wherein said orifices are equipped with a nylon bushing to allow for a smooth sliding support of the adjustable exercise bar.

5. The adjustable cantilevered aquatic exercise device according to claim 1, wherein said horizontal support arms may be rotated 180 degrees.

6. The adjustable cantilevered aquatic exercise device according to claim 1, wherein said horizontal support arms may be removed by lifting said device slightly and sliding said inverted "T" arms out of said mounting plates.

* * * * *